US009481497B1

(12) United States Patent
White

(10) Patent No.: US 9,481,497 B1
(45) Date of Patent: Nov. 1, 2016

(54) REFILLABLE SOLUTION STORAGE AND APPLICATION SYSTEM

(71) Applicant: Michael White, Raleigh, NC (US)

(72) Inventor: Michael White, Raleigh, NC (US)

( * ) Notice: Subject to any disclaimer, the term of this patent is extended or adjusted under 35 U.S.C. 154(b) by 0 days.

(21) Appl. No.: 14/564,051

(22) Filed: Dec. 8, 2014

Related U.S. Application Data

(60) Provisional application No. 61/913,254, filed on Dec. 7, 2013.

(51) Int. Cl.

| | |
|---|---|
| ***B65D 51/32*** | (2006.01) |
| ***B05C 11/11*** | (2006.01) |
| *A45D 40/26* | (2006.01) |
| *A46B 3/12* | (2006.01) |

(52) U.S. Cl.
CPC ..... *B65D 51/32* (2013.01); *B05C 11/11* (2013.01); *A45D 40/265* (2013.01); *A46B 3/12* (2013.01)

(58) Field of Classification Search
CPC ..... A46B 3/08; A46B 3/12; A45D 40/265; B05C 11/11; B65D 51/32
USPC ..... D9/526
See application file for complete search history.

(56) References Cited

U.S. PATENT DOCUMENTS

| | | | | | |
|---|---|---|---|---|---|
| 772,382 | A * | 10/1904 | Sexton | A45D 40/265 | 401/129 |
| 1,193,433 | A * | 8/1916 | Searcy | A46B 15/00 | 15/DIG. 4 |
| 2,266,022 | A * | 12/1941 | Gibbs | B43L 25/00 | 401/128 |
| D220,748 | S * | 5/1971 | Gould | D9/526 | |
| 3,895,877 | A * | 7/1975 | Fomby | A46B 3/02 | 15/171 |
| 3,992,116 | A * | 11/1976 | Fomby | A46B 3/02 | 300/21 |
| 4,955,745 | A * | 9/1990 | Vauquelin | A45D 34/045 | 401/126 |
| 5,007,553 | A * | 4/1991 | Curtis | A46B 17/06 | 15/257.05 |
| 6,213,329 | B1 * | 4/2001 | Dobson | A46B 11/0079 | 206/15.2 |
| 2002/0159820 | A1 * | 10/2002 | Louis | A45D 34/045 | 401/129 |

* cited by examiner

*Primary Examiner* — Mark A Laurenzi
*Assistant Examiner* — Bradley Oliver
(74) *Attorney, Agent, or Firm* — NK Patent Law, PLLC

(57) ABSTRACT

A solution storage and application system includes a bottle and an applicator assembly constructed to mutually engage for safe storage and transport of any desired solution within the bottle. The applicator assembly includes a handle by which the applicator assembly is to be manipulated, the handle extending from a free end to a circular flange that serves as a cap for closure of the interior of the bottle when the applicator assembly engages the bottle. A ferrule extends from the flange away from the handle and retains an applicator that extends from the ferrule away from the handle such that longitudinal ends of the handle and applicator serve as longitudinal ends of the applicator assembly.

7 Claims, 4 Drawing Sheets

REFILLABLE SOLUTION STORAGE AND APPLICATION SYSTEM

CROSS-REFERENCE TO RELATED APPLICATIONS

This application claims the benefit of provisional patent application No. 61/913,254 filed on Dec. 7, 2013, the entire contents of which are incorporated by reference herein.

TECHNICAL FIELD

The present disclosure relates to applicators and bottles. More particularly, the present disclosure relates to an integrated applicator system having a bottle and applicator assembly.

BACKGROUND

Typical containers and applicators are available separately without integrated features. A typical bottle or can for storing a solution has a lid but not an integrated applicator. For example, if an applicator such as a brush is to be dipped into a container, a lid must first be removed such that three objects, namely a container body, a lid, and an applicator must be handled by a user. Each such object potentially has messy solution on it and so applications are sometimes awkward and messy operations. Also, with many choices of previously available containers and applicators, correlation of the dimensions of an applicator and container are not assured with regard to reaching a diminishing volume of a product in the bottom of a container as the product is used.

SUMMARY

This Summary is provided to introduce in a simplified form concepts that are further described in the following detailed descriptions. This summary is not intended to identify key features or essential features of the claimed subject matter, nor is it to be construed as limiting the scope of the claimed subject matter.

A solution storage and application system according to at least one embodiment includes a bottle and an applicator assembly constructed to mutually engage for safe storage and transport of any desired solution within the bottle.

In at least one example, the bottle includes an arcuate front wall, generally vertical left and right side walls, an inclined rear wall, and a four-sided base. The junctions of adjacent walls may be beveled such that the bottle has an ergonomic outer form. The arcuate front wall and inclined rear wall extend upward from the base and converge toward each other such that the space defined within the interior the bottle reduces in horizontal cross-section from the base. The bottle further includes a circular mouth where the applicator assembly engages the bottle. The circular mouth of the bottle may lie in a plane that is sloped relative to the base. The left and right side walls may be symmetric about a vertical center plane such that the bottle has a symmetric outer form and the left and right side walls are approximately trapezoidal.

In at least one example, the applicator assembly includes a handle by which the applicator assembly is to be manipulated. The handle extends from a free end to a circular flange that serves as a cap for closure of the interior of the bottle when the applicator assembly engages the bottle. The applicator assembly may include a cylindrical skirt that extends from the flange away from the handle to surround the mouth of the bottle. Threads may extend outward from the mouth and engage corresponding threads extending inward from the skirt to secure the engagement of the applicator assembly and bottle.

The applicator assembly may include a ferrule that extends from the flange away from the handle and the ferrule may retain an applicator that extends from the ferrule away from the handle such that longitudinal ends of the handle and applicator serve as longitudinal ends of the applicator assembly.

In at least one example, the handle and applicator are centrally located relative to the flange, and dimensions of the application system are selected such that the ferrule cannot be dipped into liquid contents of the bottle in any orientation of the applicator assembly so long as the bottle is maintained in orientations that maintain the contents of the bottle below the plane of the mouth after the bottle is filled, as the base is maintained horizontal relative to gravity, to a prescribed height.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
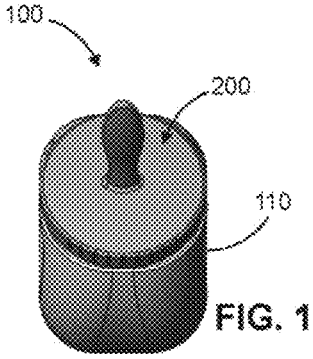
FIG. 1 is a top view of a solution storage and application system according to at least one embodiment.
Figure 5:
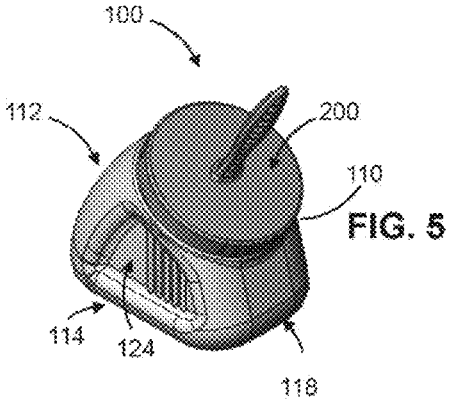
FIG. 5 is a top rear left-side perspective view of the solution storage and application system of FIG. 1.
Figure 3:
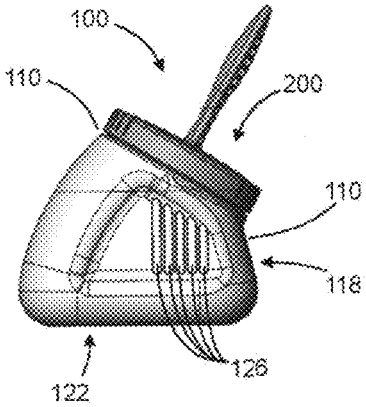
FIG. 3 is a left-side view of the solution storage and application system of FIG. 1.
Figure 2:
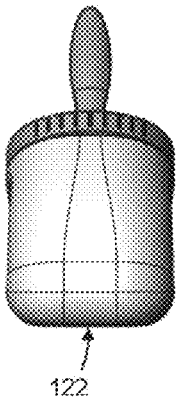
FIG. 2 is a front view of the solution storage and application system of FIG. 1.
Figure 4:
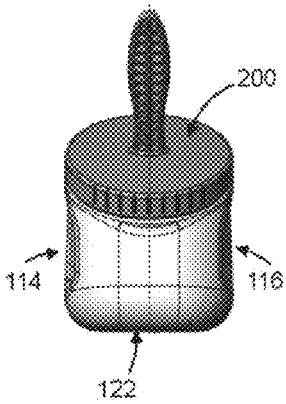
FIG. 4 is a rear-view of the solution storage and application system of FIG. 1.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters.

Some of the drawings indicate particular exemplary dimensional measurements in inches. Such examples do not limit the subject matter represented to the measurements indicated. Thus, some embodiments within the scope of these descriptions do not exhibit the measurements given. However, some embodiments within the scope of these descriptions do exhibit one or more of the measurements given. Furthermore, the drawings are not necessarily drawn to scale. Some embodiments with the scope of theses descriptions however do correspond to the apparent scale of the drawings, while other embodiments do not.

A solution storage and application system 100 according to at least one embodiment is illustrated in whole or in part in the drawings. The application system 100 includes a bottle 110 and an applicator assembly 200 that are constructed to mutually engage for safe storage and transport of any desired solution within the bottle 110. The bottle 110 has an arcuate front wall 112, generally vertical left and right side walls 114 and 116, and an inclined rear wall 118 the each meet a four-sided base 122. Junctions of adjacent walls of the bottle 110 are beveled such that the bottle 100 has an ergonomic outer form. Naturally, in use according to the preferences of any one user, the solution storage and application system 100 may be grasped and oriented at will such that references to front, back, left, right and such in these descriptions are nominal and tentative. Nonetheless, preferred orientations for in-hand use and shelf storage are described without ambiguity.

The arcuate front wall 112 and inclined rear wall 118 extending upward from the base 122 somewhat converge toward each other such that the space defined within the interior the bottle reduces in horizontal cross-section from the base 122 to a circular mouth 128 (FIG. 6) where the applicator assembly engages the bottle 112. The circular mouth 128 of the bottle 110, the plane of which is sloped relative to the base 122, has a high point at the front wall 122 and a low point at the rear wall 118. The left and right side walls 114 and 116 are symmetric about a vertical center plane such that the bottle 110 has a symmetric outer form. The left and right side walls 114 and 116 are approximately trapezoidal. That is, their length as measured along a line parallel to the base 122 from the front wall 112 to the rear wall 112, diminishes as their height from the base increases. The base 122 thus has a larger horizontal footprint than the sloped circular mouth 128, and the bottle has a stable form when placed on the base 122 so as to be advantageously unlikely to tip over particularly when weighted by liquid contents.

The left and right side walls 114 each have an inward recess 124 to accommodate secure grasping by a user, and grip ridges 126 within the inward recess 124 to accommodate finger gripping. In the illustrated embodiment, the grip ridges 124 are generally perpendicular to the base 122, which is horizontal when the bottle 110 is placed on a shelf, floor, or other horizontal support surface. As such, the grip ridges 124 are vertical when the bottle 110 is placed on a shelf and sloped when the bottle is held with the plane of the mouth 128 as horizontal relative to gravity.

Above-described features advantageously serve to contain any liquid contents within the bottle 110 and facilitate complete use of the contents with minimal waste as will be described below once related advantageous features of the applicator assembly 200 are described.

Figure 6:
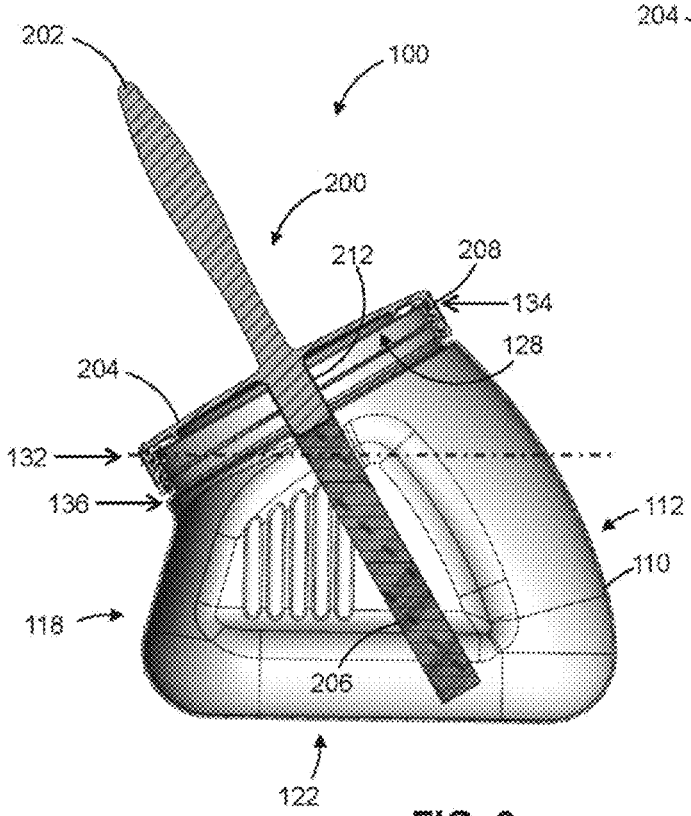
FIG. 6 is a right-side partial cross-sectional view of the solution storage and application system of FIG. 1, taken along the line A-A in FIG. 4.
Figure 7:
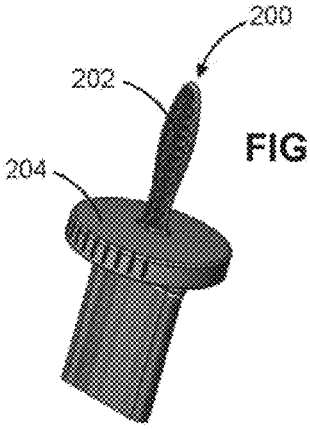
FIG. 7 is a perspective view of an applicator assembly of the solution storage and application system of FIG. 1.
Figure 8:
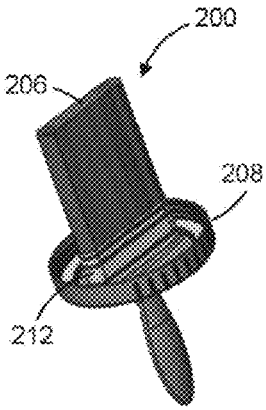
FIG. 8 is another perspective view of the applicator assembly of FIG. 8.
Figure 9:
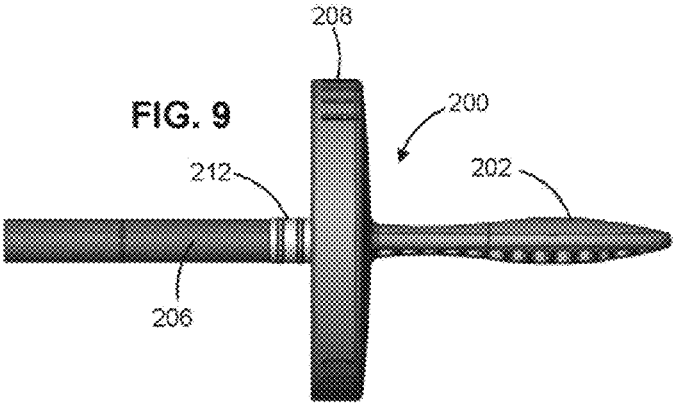
FIG. 9 is a side view of the applicator assembly of FIG. 8.
Figure 11:
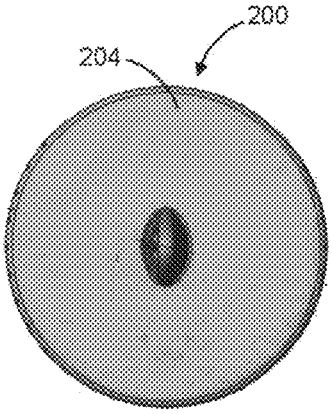
FIG. 11 is an upper view of the applicator assembly of FIG. 8.
Figure 10:
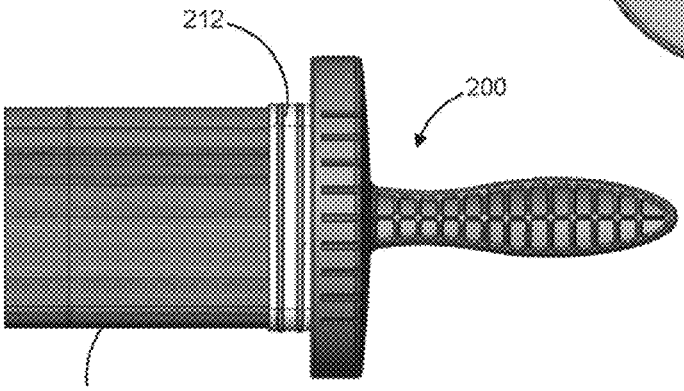
FIG. 10 is a side view taken perpendicular to the view of FIG. 9.

The applicator assembly 200 includes a handle 202 by which the applicator assembly is to be manipulated. The handle 202 extends from a free end to a circular flange 204 that serves as a cap for closure of the interior the bottle 110 when the applicator assembly engages the bottle 112. A cylindrical skirt 208 extends from the flange 204 away from the handle 202 to surround the mouth 128 of the bottle 110. Threads extend outward from the mouth 128 and engage corresponding threads extending inward from the skirt 208 to secure the engagement of the applicator assembly 200 and bottle 110 as shown in FIG. 6. Thus the applicator assembly 200 can be engaged with and removed from the bottle 110 by relative rotation around the axis of the handle 202.

A ferrule 212 extends from the flange 204 away from the handle 202. The ferrule 212 retains an applicator 206 illustrated in the embodiment of the drawings as a flexible fibrous brush. The applicator 206 extends from the ferrule 212 away from the handle 202 such that longitudinal ends of the handle 202 and applicator 206 serve as longitudinal ends of the applicator assembly 200. The applicator 206 has a width that extends along a diametrical line of the circular flange 204, and the handle 202 extends from the geometric center of the flange 204, such that the handle 202 and applicator 206 are centrally located relative to the flange 204, and the applicator assembly 200 is symmetric about a plane in which the width of the applicator 206 is defined. The applicator assembly 200 can be generally handled as a one-piece implement having a rigid construction from the handle 202 to the ferrule 202 and a flexible applicator 206.

The application system 100 includes features that advantageously serve to contain any liquid contents within the bottle 110 and facilitate complete use of the contents with minimal waste due to conjunctive features of the bottle 110 and applicator assembly 200. Note particularly in FIG. 6 that the ferrule 212 terminates further from the base 112 than the low point of the sloped mouth 128, the height of which is represented by a dashed horizontal line in FIG. 6. Note that the flange 204 serves as a depth stop, dimensioned too large to fit through the mouth 128, thus limiting the reach of the ferrule 212 and applicator 206 into the bottle 110. This assures that when the bottle 110 is filled to a reasonable height with liquid contents below the low point of the sloped mouth 128 as the bottle perches on a shelf or other horizontal support structure, the ferrule 212 will not be dipped into the liquid contents so long as the bottle 110 is maintained in orientations that maintain the contents of the bottle below the plane of the mouth 128. This is true, due at least in part to the central location of the ferrule 212 and handle 202 relative to the flange 204, whether the bottle is leaned toward the low point 132 of the mouth or the high point 134 of the mouth 128. The ferrule 202 can thus be maintained relatively clean of liquids as the bottle 110 is held with the plane of mouth 128 approximately horizontal relative to gravity and the applicator 206 is dipped into the liquid contents for applying a product from the bottle to a desired work piece or surface being treated.

Furthermore, with the plane of the mouth 128 held as approximately horizontal, liquid contents of the bottle 110 collect in the lowest part of the internal space of the bottle along the junction of the front wall 112 and base 122. With the width of the applicator 206 held approximately parallel to the junction, the end of the applicator is able to reach diminishing levels of the contents as the contents are spent by multiple returns of the applicator 206 to the contents. As seen in FIG. 6, the front wall 112 and rear wall 118 meet the mouth area of the bottle at very different angles, providing the user with a variety of modes of dragging the applicator 206 along an exit surface of the bottle according to user preference toward saturation and mild shaping of the applicator.

Furthermore, in at least one embodiment, dimensions of the application system 100 are selected such that the ferrule 202 cannot be dipped into the liquid contents in any orientation of the applicator assembly 200 so long as the bottle 110 is maintained in orientations that maintain the contents of the bottle below the plane of the mouth 128 after the bottle 110 is filled, as the base 122 is maintained horizontal relative to gravity, to a reasonable height with liquid contents below the low point 132 of the sloped mouth 128 or fill limit shoulder 136 approximately at the junction of the mouth and rear wall 118.

The storage and application system 100 can be used to store and apply many types of solutions to many types of surfaces. For example, protective solutions for automotive tires and other weather and sun sensitive components such as door and window gaskets, including interior surfaces, can be stored and applied from the system 100. The system is also applicable for use with paints, cleaning solutions, solvents, marinades, glazes, pastes, gels, and powders without limitation expressed or implied in these descriptions.

Figure 12:
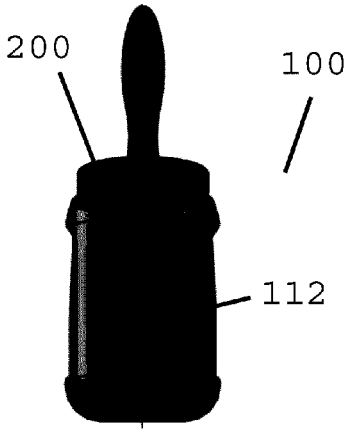
FIG. 12 is a front view of a solution storage and application system according to at least one embodiment.
Figure 13:
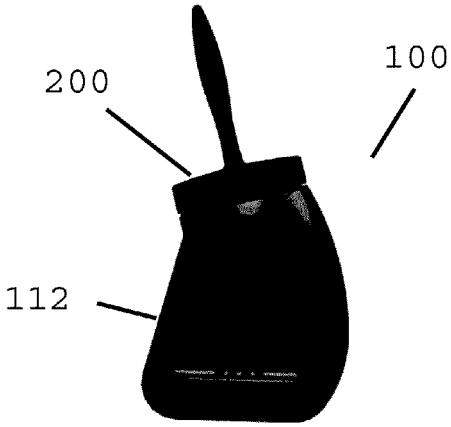
FIG. 13 is a side view of a solution storage and application system of FIG. 12.
Figure 14:
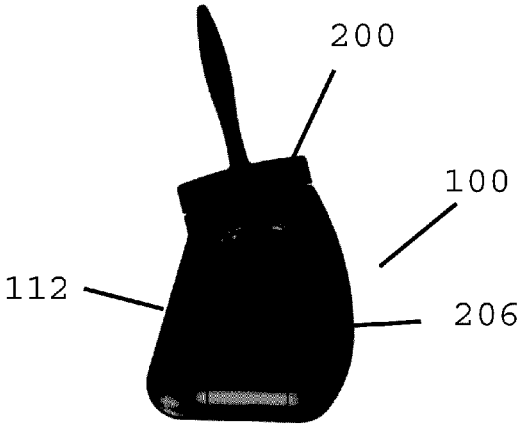
FIG. 14 is a side view where an applicator is shown exposed of a solution storage and application system of FIG. 12.

One or more additional embodiments of a storage and application system 100 are illustrated in FIGS. 12, 13, and 14. The container 112 illustrated in these embodiments is more elongate than the container of FIGS. 1 through 11, however, shares many of the same features. Like referenced parts are illustrated with like referenced numbers in FIGS. 1 through 11 and the descriptions of FIGS. 1 through 11 are thus appropriate for the embodiments illustrated in FIGS. 12, 13, and 14. The applicator assembly 200 may be the same or have many similar features in the embodiments illustrated in FIGS. 12, 13, and 14, as those illustrated in FIGS. 1 through 11.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A solution storage and application system comprising:

a bottle for containing a viscous liquid solution, the bottle comprising:

an arcuate front wall;

generally vertical left and right side walls;

an inclined rear wall; and a base;

an applicator assembly constructed to mutually engage the bottle for safe storage and transport of solution therein, wherein the applicator assembly is engaged with the bottle at a mouth of the bottle that is angled relative to a base of the bottle such that the applicator assembly extends into the bottle at a non-orthogonal angle towards the arcuate front wall;

wherein the applicator assembly comprises:

a handle by which the applicator assembly is to be manipulated, the handle extending from a free end to a circular flange that serves as a cap for closure of the bottle when the applicator assembly engages the bottle;

a cylindrical skirt that extends from the flange away from the handle to surround the mouth of the bottle, wherein threads extend outward from the mouth and engage corresponding threads extending inward from the skirt to secure the engagement of the applicator assembly and bottle; and a ferrule that extends from the flange away from the handle, wherein the ferrule retains an applicator that extends from the ferrule away from the handle such that longitudinal ends of the handle and applicator serve as longitudinal ends of the applicator assembly;

wherein dimensions of the application system are selected such that the ferrule cannot be dipped into liquid contents of the bottle in any orientation of the applicator assembly so long as the bottle is maintained in orientations that maintain the contents of the bottle below the plane of the mouth after the bottle is filled, as the base is maintained horizontal relative to gravity, to a prescribed height.

2. A solution storage and application system according to claim 1, wherein junctions of adjacent walls are beveled such that the bottle has an ergonomic outer form.

3. A solution storage and application system according to claim 2, wherein the arcuate front wall and inclined rear wall extend upward from the base and converge toward each other such that the space defined within the interior the bottle reduces in horizontal cross-section from the base.

4. A solution storage and application system according to claim 3, wherein the mouth is circular.

5. A solution storage and application system according to claim 4, wherein the left and right side walls are symmetric about a vertical center plane such that the bottle has a symmetric outer form.

6. A solution storage and application system according to claim 1, wherein the handle and applicator are centrally located relative to the flange.

7. A solution storage and application system comprising:

a bottle for containing a viscous liquid solution, the bottle including:

an arcuate front wall;

generally vertical left and right side walls;

an inclined rear wall;

a base; and a mouth defined at an angle relative to the base; and an applicator assembly selectively engaged with the mouth and including:

a handle extending from a cap engaged with the mouth;

a plurality of bristles extending from a bottom facing portion of the cap and extending into the bottle at a non-orthogonal angle towards the arcuate front wall; and a ferrule attaching the bristles to the cap, wherein the ferrule does not extend below a horizontal defined at a liquid level of the reservoir such that liquid does not contact the ferrule when the system is resting on the base.

* * * * *